US009169741B2

(12) United States Patent
Szwedowicz et al.

(10) Patent No.: US 9,169,741 B2
(45) Date of Patent: Oct. 27, 2015

(54) TURBOMACHINE CLEARANCE CONTROL CONFIGURATION USING A SHAPE MEMORY ALLOY OR A BIMETAL

(75) Inventors: Jaroslaw Leszek Szwedowicz, Bad Zurzach (CH); Alexey Mozharov, Nussbaumen (CH); Stefan Irmisch, Oberrohrdorf (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 547 days.

(21) Appl. No.: 13/479,315

(22) Filed: May 24, 2012

(65) Prior Publication Data

US 2012/0301280 A1 Nov. 29, 2012

(30) Foreign Application Priority Data

May 24, 2011 (CH) ..... 0882/11

(51) Int. Cl.
*F01D 11/14* (2006.01)
*F01D 11/18* (2006.01)
*F01D 11/24* (2006.01)

(52) U.S. Cl.
CPC ..... *F01D 11/18* (2013.01); *F01D 11/24* (2013.01); *F05D 2300/505* (2013.01)

(58) Field of Classification Search
CPC ..... F01D 11/12; F01D 11/16; F01D 11/18; F01D 11/20; F01D 11/22
See application file for complete search history.

(56) References Cited

U.S. PATENT DOCUMENTS 4,247,247 A 1/1981 Thebert
5,403,158 A 4/1995 Auxier
6,126,390 A * 10/2000 Bock ..... 415/115
6,318,070 B1 * 11/2001 Rey et al. ..... 60/226.3
6,427,712 B1 * 8/2002 Ashurst ..... 137/62

(Continued)

FOREIGN PATENT DOCUMENTS

CN 1228505 A 9/1999
CN 1661200 A 8/2005

(Continued)

OTHER PUBLICATIONS

Machine Translation—WIPO 2010/072968, Retreived from <http://patentscope.wipo.int/search/en/search.jsf> on Sep. 29, 2014.*

(Continued)

*Primary Examiner* — Nathaniel Wiehe
*Assistant Examiner* — Woody A Lee, Jr.
(74) *Attorney, Agent, or Firm* — Buchanan Ingersoll & Rooney PC

(57) ABSTRACT

A turbomachine which operates at enhanced operating temperatures includes a stationary component. A rotating component includes a clearance to avoid a rubbing contact between the stationary component and the rotating component, the clearance including a first value in a stationary state of the turbomachine and a second value in a steady-state operation of the machine, wherein during a transient operating phase between the stationary state and the steady-state operation, the clearance includes a value which traverses a curve having an extreme value on account of a different time variation of a rotational speed and a thermal expansion of different components. A compensating device includes a non-linear compensation mechanism configured to reduce or compensate the extreme value during the transient operating phase.

12 Claims, 4 Drawing Sheets

(56) References Cited

U.S. PATENT DOCUMENTS

| | | | | |
|---|---|---|---|---|
| 7,052,017 | B2 * | 5/2006 | Uchida et al. | 277/420 |
| 7,198,454 | B2 * | 4/2007 | Evans | 415/12 |
| 7,198,463 | B2 * | 4/2007 | Kanebako et al. | 415/175 |
| 7,334,996 | B2 * | 2/2008 | Corbin et al. | 416/221 |
| 7,367,776 | B2 * | 5/2008 | Albers et al. | 415/173.1 |
| 7,572,099 | B2 | 8/2009 | Addis | |
| 7,655,001 | B2 * | 2/2010 | Petrakis | 604/890.1 |
| 7,686,569 | B2 | 3/2010 | Paprotna et al. | |
| 7,946,808 | B2 * | 5/2011 | Taylor et al. | 415/173.7 |
| 8,052,380 | B2 * | 11/2011 | Willett, Jr. | 415/173.5 |
| 8,113,771 | B2 * | 2/2012 | Turnquist et al. | 415/173.3 |
| 8,142,141 | B2 * | 3/2012 | Tesh et al. | 415/173.7 |
| 2004/0211177 | A1 * | 10/2004 | Kutlucinar | 60/527 |
| 2005/0207892 | A1 | 9/2005 | Kanebako et al. | |
| 2006/0165518 | A1 | 7/2006 | Albers et al. | |
| 2008/0008580 | A1 | 1/2008 | Addis | |
| 2008/0079222 | A1 * | 4/2008 | Namuduri et al. | 277/359 |
| 2009/0226327 | A1 | 9/2009 | Little et al. | |
| 2010/0104416 | A1 * | 4/2010 | Willett, Jr. | 415/48 |
| 2012/0003080 | A1 * | 1/2012 | Deo et al. | 415/174.5 |

FOREIGN PATENT DOCUMENTS

| | | | |
|---|---|---|---|
| EP | 1467066 | A2 | 10/2004 |
| EP | 1686243 | A2 | 8/2006 |
| GB | 2354290 | A | 3/2001 |
| JP | 57-195803 | A | 1/1982 |
| JP | 58206807 | A | 12/1983 |
| JP | 60111004 | A | 6/1985 |
| JP | 61-103504 | U | 7/1986 |
| JP | 7-253003 | A | 10/1995 |
| JP | 2006-207584 | A | 8/2006 |
| JP | 2008-014298 | A | 1/2008 |
| JP | 2009-203948 | A | 9/2009 |
| JP | 2009-243444 | | 10/2009 |
| RU | 87 213 | U1 | 9/2009 |
| SU | 1506209 | A1 | 9/1989 |
| WO | WO 2010072968 | A1 * | 7/2010 |
| WO | 2010112421 | A1 | 10/2010 |

OTHER PUBLICATIONS

European Patent Office, Search Report in Swiss Patent Application No. 882/2011 (Jul. 29, 2011).

First Office Action issued on Jul. 29, 2014, by the Chinese Patent Office in corresponding Chinese Patent Application No. 201210163558.2, and an English Translation of the First Office Action. (19 pages).

Office Action (Notification of Reasons for Refusal) issued on Sep. 1, 2014, by the Japan Patent Office in corresponding Japanese Patent Application No. 2012-118739, and an English Translation of the Office Action. (5 pages).

Decision of Refusal issued on Jun. 15, 2015 by the Japanese Patent Office in corresponding Japanese Patent Application No. 2012-118739, and an English translation thereof (6 pages).

Office Action issued Jan. 15, 2015 by the Russian Patent Office in corresponding Russian Application No. 2012121355/06 (6 pages).

* cited by examiner

TURBOMACHINE CLEARANCE CONTROL CONFIGURATION USING A SHAPE MEMORY ALLOY OR A BIMETAL

CROSS-REFERENCE TO PRIOR APPLICATIONS

Priority is claimed to Swiss Patent Application No. CH 00882/11, filed on May 24, 2011, the entire disclosure of which is hereby incorporated by reference herein.

TECHNICAL FIELD

The present invention relates to the field of turbomachines such as gas turbines, steam turbines, aircraft engines, stationary compressors or turbochargers.

BACKGROUND OF THE INVENTION

The minimizing of clearances, especially the radial clearances between stationary and rotating parts of a turbomachine during operation is vital for minimizing flow losses and therefore for maximizing the efficiency of such machines. By way of illustration, FIG. 1 shows an example of a turbomachine 10 in the form of a compressor arrangement with a rotor blade 14 which is seated on a rotating (around an axis 13) shaft 12 and a stator blade 15 which is fastened on a casing 11. By minimizing the radial clearances $C_b$ and $C_v$ between the tips of the rotor blade 14 and the oppositely disposed casing 11 or between the tip of the stator blade 15 and the oppositely disposed shaft 12, the flow losses can be reduced.

On account of the relative movement, e.g. between the blade tip of the rotor blade 14 and the casing 11, it is not possible to set the radial clearance to zero. Contact between both parts during operation can lead to damage or even to the complete destruction of the parts.

It is basically the case that the radial clearances during operation (so-called "hot clearances") are determined by a series of factors which have to be taken into consideration in the construction of such a machine when the assembly clearances (so-called "cold clearances", in the stationary state of the cold machine) are determined

- The manufacturing tolerances of the individual components;
- The assembly tolerances;
- The expansion of the blades during operation on account of thermal effects and centrifugal forces;
- The deformation of shaft and casing in steady-state operation (e.g. in the form of so-called "ovalization") and
- Time-dependent deformations and relative movements of all components during transient machine operation (operational transition phase of the machine), such as the starting up or the shutting down of the machine.

In particular, the time-dependent deformations and relative movements of the main components during transient operation are of importance for the determination of the cold clearance and the hot clearance resulting therefrom. The aim is to determine the cold clearance in such a way that during steady-state operation the resulting hot clearance is minimal. On account of the different time constants in the mechanical and thermal deformation of the blades, of the casing parts and of the shafts during the warming-up or cooling-down of the machine, the minimum hot clearance will not necessarily occur during hot steady-state operation where the minimum clearance is desired. As a rule, the smallest possible clearance (so-called "pinch point") will occur during a transient operating phase, especially if it is taken into consideration that the machine is also subjected to rapid load changes or can be started when essential components are still hot from a previous operating period. In such a case, it is necessary to increase the cold clearance to such an extent that a hard contact between stationary and rotating parts during the transient operation is avoided, which then consequentially leads under steady-state conditions to a hot clearance which is larger than desired.

Measures for minimizing the flow losses, which are created as a result of remaining hot clearances, include, for example, the introduction of shrouds at the tips of the rotor blade airfoils and stator blade airfoils. In order to minimize the flow through the annular gap between shroud and casing or rotor, a rib, or a plurality of ribs, are frequently provided on the rotating part in the circumferential direction, whereas the surface of the stationary part can be flat or stepped in order to collectively form a labyrinth-like seal. Furthermore, so-called honeycombs (honeycomb-like material) can be arranged on the surface of the stationary part in order to enable the ribs to cut in during the transient operating states so as to avoid a hard contact. The configuration consisting of rotating part and cut-in honeycomb, which results in the process, resembles a stepped labyrinth seal and helps to reduce the flow losses compared with a configuration without honeycomb. Further measures for minimizing the hot clearances entail attaching so-called leaf seals or brush seals on the stationary part which can compensate the changes in the clearance during operating transition phases up to a certain degree.

Finally, a combination of abrading elements and abradable coatings, for example, can be used on the counter side in order to alleviate the negative effect of the clearance variations which occur over the circumference and can be brought about, for example, as a result of the ovalization of structural parts or of a certain eccentricity of the shaft inside the casing.

Whereas all previously mentioned solutions are of a purely passive nature, which enable a minimizing of the hot clearance without any active adjustment of the geometry during operation, there are also a number of active measures for clearance reduction.

Thus, in a system the entire rotor is displaced in the axial direction if the machine has achieved its steady-state operating condition. In conjunction with a conical flow passage, this makes it possible to actively minimize the radial clearances in the hot turbine, wherein a combination with the above-described passive measures is basically possible. Since, however, the entire rotor has to be moved, enlargements of the radial clearances on the compressor side are created. Therefore, this measure is only of advantage providing the reduction of the losses in the turbine outweigh the additional loss on the compressor side.

Instead of a displacement of the shaft, other solutions propose to control either the radial thermal expansion of the blades in each turbine stage, or to use a spring system which enables an additional radial movement of the heat shields above a predetermined limiting temperature.

Adjusting means can be used for the linear adjustment of the clearance or even elastically resilient bearing means can be used. The latter is described in EP 1 467 066 A2, for example. With these technical solutions, it is not possible, however, to compensate an extreme value in the clearance in an operational transition phase of the machine.

Document US 2009/0226327 A1 describes a restrictor, produced from a so-called memory alloy, which is installed in the rotor disk. Depending upon the local temperatures, this restrictor controls the volume of cooling medium flow into the turbine blade. By reducing the cooling medium flow, the blade thermally expands and so reduces the radial gap between the blade tip and the oppositely disposed stationary component. By increasing the cooling medium flow, the blade length is reduced and so increases the radial gap.

Printed publication GB 2 354 290 describes a valve, produced from a memory alloy, which is installed in the cooling passage of the gas turbine blade. The valve regulates the consumption of cooling medium as a function of the temperature of the component. Controlling of the radial clearance for rotor blades and stator blades is not described in this document.

Printed publication U.S. Pat. No. 7,686,569 describes a system for the axial movement of a blade ring which is brought about as a result of a pressure difference applied to the blade ring, of the thermal expansion or contraction of a connection or by a piston. A memory alloy can also bring about the necessary movement.

Different passive, semi-active or active systems, and also combinations thereof, can basically be considered for controlling the clearances between rotating components and stationary components. The clearances $C_b$ or $C_v$, which define the relative distance between a rotating component and a stationary component (FIG. 1), vary during transient operating states as a consequence of the different and time-dependent thermal and mechanical deformations of the components. The actual time variation depends upon a large number of factors, such as the volume of the components, the contact with hot or cold media, and the thermal properties of the alloys which are used.

On account of these time-differentiated deformations, according to FIG. 2(*a*) the "hot" clearance $C_b$ (in the case of rotor blades) or $C_v$ (in the case of stator blades), in addition to a safety clearance $C_s$, must also include a transient portion $g_{t,min}$. This transient portion must also be taken into consideration in the definition of the clearances in the cold assembled state, $C_{\beta,o,min}$ and $C_{\beta,o,max}$.

FIG. 2 shows in sub-FIG. 2(*a*) an example of the change over time t of the clearance between rotating and stationary hot parts for steady-state operating phases (st) and transient operating phases (tr), wherein—as already mentioned—$C_s$ represents a safety clearance, $g_a$ is a tolerance band on account of the manufacturing and assembly tolerances of the components, $g_{t,min}$ and $g_{t,max}$ represent the minimum and maximum differences between the clearance in the steady-state condition and the minimum clearance, $C_{\beta,min}$ and $C_{\beta,max}$ stand for the minimum and maximum clearances for the nominal ("hot") operating conditions, and $C_{\beta,o,min}$ and $C_{\beta,o,max}$ represent the corresponding minimum and maximum clearances in the stationary state ("cold" operating condition) (the index 13 in this case stands for "b" or rotor blade, or "v" or stator blade, see FIG. 1).

FIGS. 2(*b*) and (*c*) show possible variations of the rotational speed Ω of the shaft 12, of the temperature T of the working medium (hot gas) and of the metal temperature $T_m$ over time t, wherein $\Omega_n$ and $T_n$ correspondingly stand for the nominal rotational speed and nominal hot gas temperature in the machine. The metal temperature $T_{mn}$ refers to the nominal temperature of the shaft and/or to another mechanical component during the steady-state operation of the machine. $t_{\Omega n}$ and $t_{Tn}$ in this case are the time points at which the steady-state values $\Omega_n$ and $T_n$ are achieved.

FIG. 3 shows the cross section through a rotating component (a rotor blade 14 in the example)—which is fastened by a root 16 in a corresponding carrier in the rotor (shaft 12)—in the stationary state of the machine (FIG. 3(*a*)) and under nominal steady-state operating conditions (FIG. 3(*b*)). The depicted root 16 is representative in this case for any root geometry, such as a firtree root, a dovetail root or an inverted-T root. It engages by fingers 18 in corresponding lateral grooves 17 in the carrier, e.g. in the rotor.

The centrifugal force brings one, or a plurality of fingers 18, of the root 16 into contact with the rotor 12 (FIG. 3(*b*)). At low rotational speed, a spring element 19 prevents the root 16 rattling in the carrier at slow rotational speeds. At nominal rotational speed and after achieving the thermal equilibrium of all the components of the machine, clearances $C_b$ or $C_v$ are achieved according to FIG. 1. The designation $g_a$ in this case again stands for the tolerance band consisting of manufacturing and assembly tolerances and is shown here by way of example between fingers 18 and the carrier in the rotor in the stationary state of the machine.

During start-up of the machine, the thermal expansion of the blading is typically very much quicker than that of the casing parts or that of the rotor shaft, which on account of their greater mass have a higher thermal inertia than the blades. This means that the heating up and therefore the thermal expansion of the shaft or other structural parts continues, even after the working medium has already reached the nominal operating temperature $T_n$ (time point $t_{Tn}$ in FIG. 2(*c*)). This circumstance leads to the occurrence of a so-called "pinch point", i.e. a time point during the warming-up phase during which the radial clearance achieves its minimum value (see FIG. 2(*a*)). For this reason, for the nominal steady-state operating condition the resulting minimum clearance $C_{b,min}$ (or $C_{v,min}$) must include a safety clearance $C_s$ and also a minimum transient contribution to the clearance $g_{t,min}$. This must be analytically determined in the design of the machine and depends upon the thermal boundary conditions, dimensions and material properties of the rotating and stationary components. The transient contributions to the gap $g_{t,min}$ and $g_{t,max}$ prevent the blade tips rubbing against the stationary casing or stationary heat shields or against the rotor or the rotor heat shields.

Under the nominal stationary operating condition, if all the rotating and stationary parts have reached their maximum thermal and mechanical deformations, the transient contribution to the "pinch-point" gap ($g_t$) is an essential part of the clearance in the "hot" steady-state condition $C_{b,min}$ (or $C_{v,min}$).

SUMMARY OF THE INVENTION

In an embodiment, the present invention provides a turbomachine which operates at enhanced operating temperatures and includes a stationary component. A rotating component includes a clearance to avoid a rubbing contact between the stationary component and the rotating component, the clearance including a first value in a stationary state of the turbomachine and a second value in a steady-state operation of the machine, wherein during a transient operating phase between the stationary state and the steady-state operation, the clearance includes a value which traverses a curve having an extreme value on account of a different time variation of a rotational speed and a thermal expansion of different components. A compensating device includes a non-linear compensation mechanism configured to reduce or compensate the extreme value during the transient operating phase.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
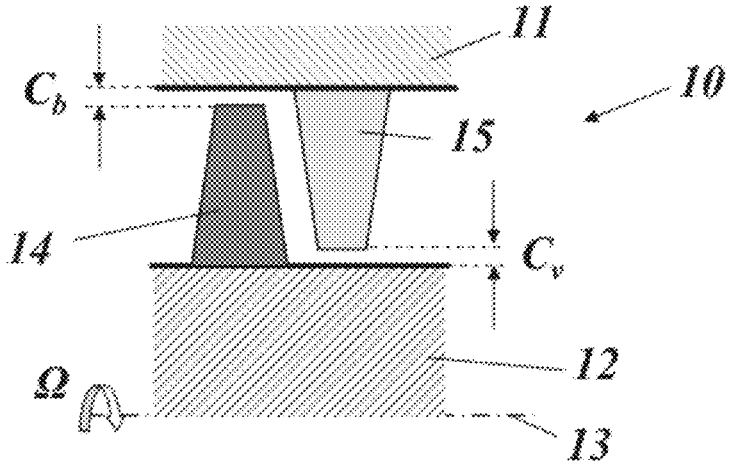
FIG. 1 shows in a greatly simplified sectional view the mechanical clearance between rotating and stationary parts in a turbomachine of the conventional type according to the prior art.

In an embodiment, the clearance between rotating and stationary parts is optimized in a simple manner for various operating states.

The invention is based on a turbomachine, operating at enhanced operating temperature, having stationary and rotating components, between which a clearance is provided for avoiding a rubbing contact, which clearance assumes a first value in the stationary state of the machine and a second value during steady-state operation of the machine, and which in a transient operating phase between stationary state and steady-state operation traverses a curve having an extreme value on account of different time variations of the rotational speed and the thermal expansion of different components. The invention is characterized in that provision is made for compensating means with a non-linear compensation mechanism for reducing or compensating the extreme value in the transient operating phase.

The problem of the occurrence of an extreme value in the clearance in an operational transition phase of the machine, upon which the application is based, is solved by the provided compensating means not having its maximum excursion at the start or end of the transition but in the transition region itself, in fact where the extreme value of the clearance occurs. To this end, a non-linear compensation mechanism is used in the compensating means and is superimposed by two movements in opposite directions, for example.

One development of the turbomachine according to the invention is characterized in that the compensating means comprise a self-adjusting device which increases or decreases the clearance as a function of external parameters.

In particular, the self-adjusting device changes its shape for increasing or decreasing the clearance.

Another development is distinguished by the self-adjusting device having a predetermined height, and by the self-adjusting device changing its height for increasing or decreasing the clearance.

A further development of the invention is characterized in that the self-adjusting device increases or decreases the clearance as a function of its temperature.

In particular, the self-adjusting device has a hysteresis in its temperature behavior.

According to a further development, the self-adjusting device contains a bimetal.

It is also conceivable that the self-adjusting device contains a shape-memory alloy.

Yet another development of the invention is characterized in that the rotating components are rotor blades, and in that the clearance which is to be influenced exists between the tips of the rotor blades and the oppositely disposed stationary casing.

A further development is distinguished by the stationary components being stator blades, and by the clearance which is to be influenced existing between the tips of the stator blades and the oppositely disposed rotor.

Another development is characterized in that the rotor blades are seated in each case by a blade root in a carrier in the rotor and are supported by supporting means against aggressive centrifugal forces on the rotor, and in that the self-adjusting device is arranged between the supporting means and the rotor.

A further development is characterized in that the self-adjusting device changes its height in the radial direction in a temperature-controlled manner between a first value and a second value, and in that the difference of the two values corresponds to the extreme value of the curve of the clearance.

The present invention relates to the use of a self-adjusting device, comprising a bimetal element and/or a shape-memory alloy element and/or an element consisting of another material, which in an elastic, super-elastic or pseudo-elastic manner changes its shape above a limit value of temperature, pressure or mechanical load, which is actively or passively activated, and which is arranged in a turbomachine in order to minimize the clearances during operation and under different operating conditions. The self-adjusting device in this case can be accommodated in a sub-assembly of a turbine, in a compressor blade, in a stator heat shield or rotor heat shield, in a stator-blade carrier, or in other rotating or stationary components which are attached on the rotor or on the casing.

Figure 4:
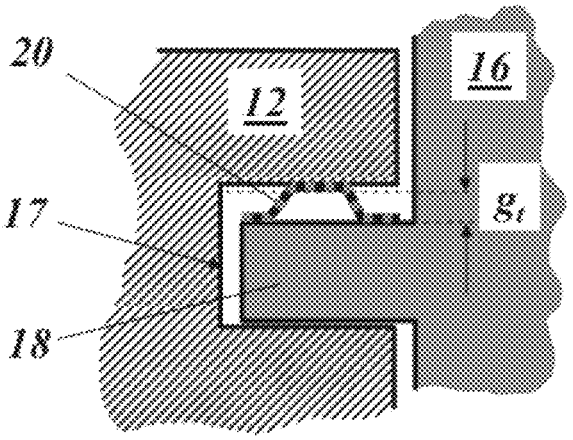
FIG. 4 shows in a greatly simplified sectional view a self-adjusting system for controlling the clearance in an anchoring according to FIG. 3 according to an exemplary embodiment of the invention.

As an example of the application of the invention, the fastening of a rotor blade on the rotor of a turbine is described by way of example in the following. FIG. 4 shows a self-adjusting device 20 which is arranged between the finger 18 of a blade root 16 and the associated groove 17 in the rotor 12. The deformations of the self-adjusting device 20 can be characterized as a. being brought about as a result of an external 2-way effect which is initiated by an acting external force, such as the centrifugal force, and/or
b. as being brought about as a result of an internal 2-way effect, such as in the case of a shape-memory alloy in which no external force is necessary in order to activate the desired deformation of the system.

The shape of the self-adjusting device 20 can be largely optional and generally depends upon the available space. Vital in the shape is the height, as is shown in FIG. 4. In the example shown there, the height of the self-adjusting device 20, under the condition of the stationary state of the machine, corresponds to the minimum difference (to the transient gap contribution) which would exist without using the self-adjusting device 20. When the machine is being ramped up, the centrifugal forces, which act upon the blade, are transmitted via the finger 18, through the self-adjusting device 20, to the groove 17 in the rotor 12. These forces increase as rotational speed increases. The elastic properties of the self-adjusting device 20, at the height $g_t$, prevent the device from being compressed flat. As a consequence thereof, the clearance at the blade tip, with the same blade length, remains larger than without the self-adjusting device 20. A certain flattening of the self-adjusting device 20 on account of the mechanical load can be accepted, however.

As power increases, from no-load to full load operation, the temperature in the machine increases. This warming-up process, with regard to the rotational speed, requires much more time (FIG. 2(*b*),(*c*)) and the various parts of the machine reach the steady-state temperature $T_n$ at different time points. The "slowest" component when warming up is typically the rotor. As the temperature of the blade root 16 and of the rotor 12 rises, the temperature of the self-adjusting device 20 also increases on account of the thermal conduction on the contact surfaces and on account of convective heat transfer due to any hot gas flows around the blade root 16.

Figure 5:
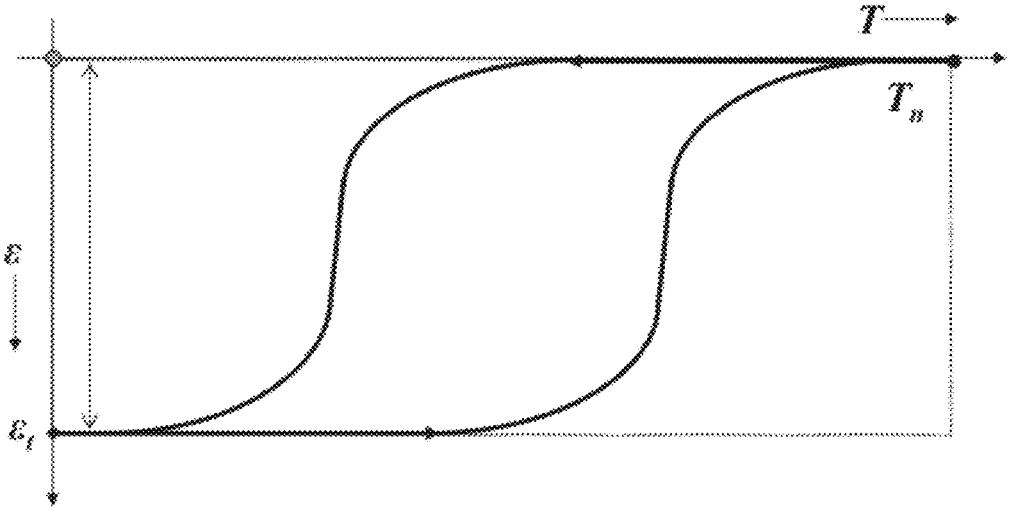
FIG. 5 shows an example of the thermo-mechanical hysteresis of a self-adjusting system according to the invention.
Figure 6:
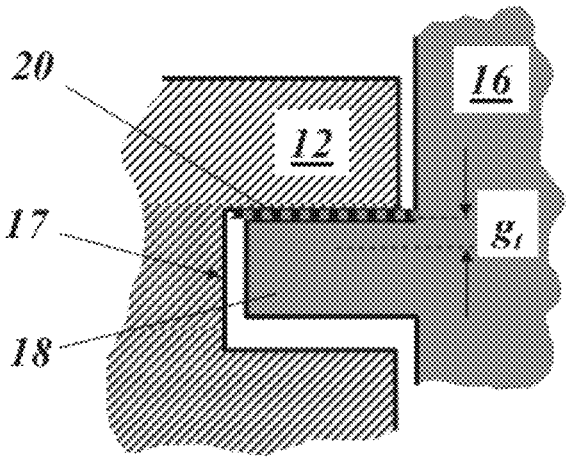
FIG. 6 shows in a greatly simplified sectional view a self-adjusting system according to FIG. 4 at nominal rotational speed.

The material of the self-adjusting device 20 is conditioned (trained) so that its mechanical properties change as a function of its temperature T in accordance with a hysteresis behavior, as is shown in FIG. 5. In the stationary state and at ambient temperature, the self-adjusting device 20 is deformed from its flat state to the maximum as a result of an expansion $\epsilon_t$, with $\epsilon_t=\sigma_t/E$, which corresponds to the transient gap contribution $g_t$ (FIG. 4). As temperature T increases, the self-adjusting device 20 changes its rigidity in accordance with the trained hysteresis and, according to FIG. 6, becomes completely flat when the prespecified temperature $T_n$ is reached. During shut-down of the machine, the thermo-mechanical properties of the self-adjusting device 20 follow the upper curve of the preprogrammed hysteresis (see arrows in FIG. 5).

If the self-adjusting device 20 is provided with the correct height ($g_t$) and it is brought to the necessary elastic or super-elastic or pseudo-elastic behavior state and thermal hysteresis, which corresponds to the centrifugal load and to the warming up and cooling down of the adjacent components, it is possible to minimize, or even to completely avoid, the occurrence of a transient "pinch point" clearance. As a consequence thereof, the clearance in the stationary hot state assumes its smallest possible minimum value, taking into consideration the minimum necessary safety clearance. In the ideal case, the length of the blade can be increased by the amount $g_t$ for the case without the self-adjusting device 20 so that the minimum resulting clearance $C_{\beta,o,min}$ is equal to $C_s$ (see FIG. 2(*a*) and FIG. 7).

Figure 2:
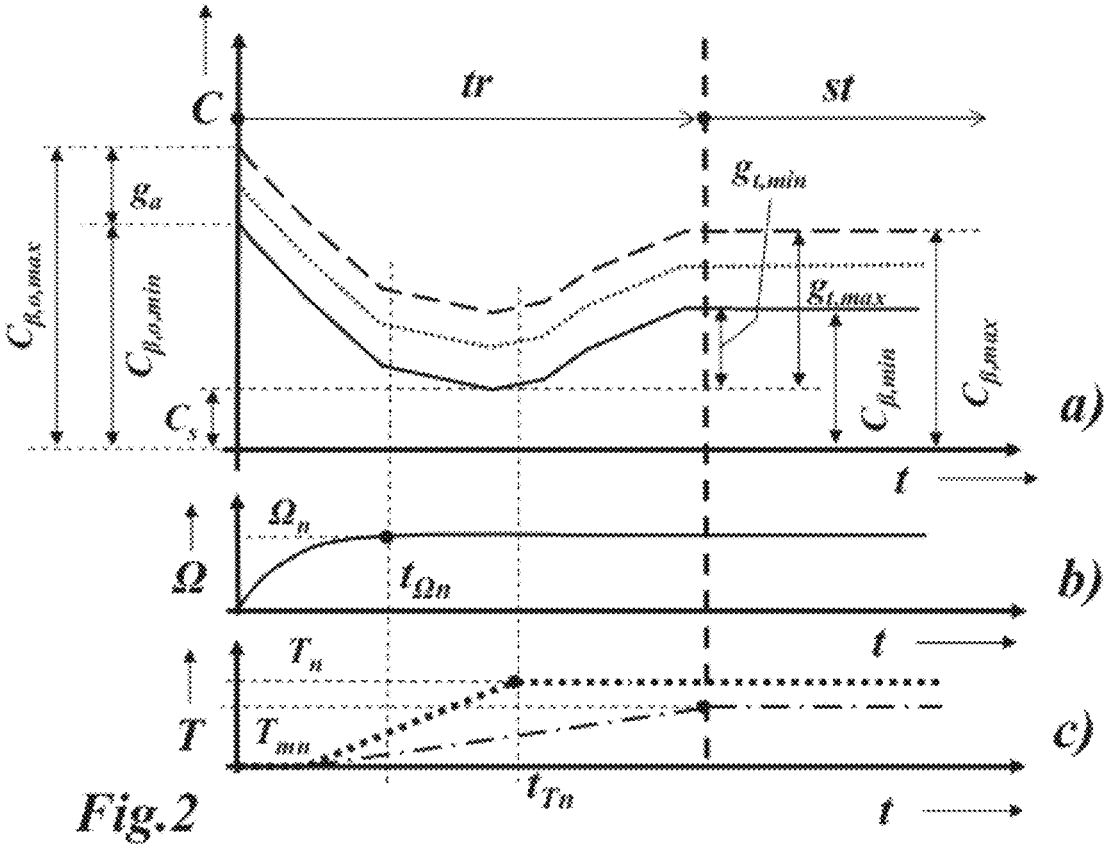
FIG. 2 shows in a number of sub-figures the time dependency of the clearance in a turbomachine when going through a transient starting process until achieving a steady-state operating condition (FIG. 2(*a*)), and also the associated time dependency of the rotational speed (FIG. 2(*b*)) and of the hot gas and metal temperature (FIG. 2(*c*))
Figure 3:
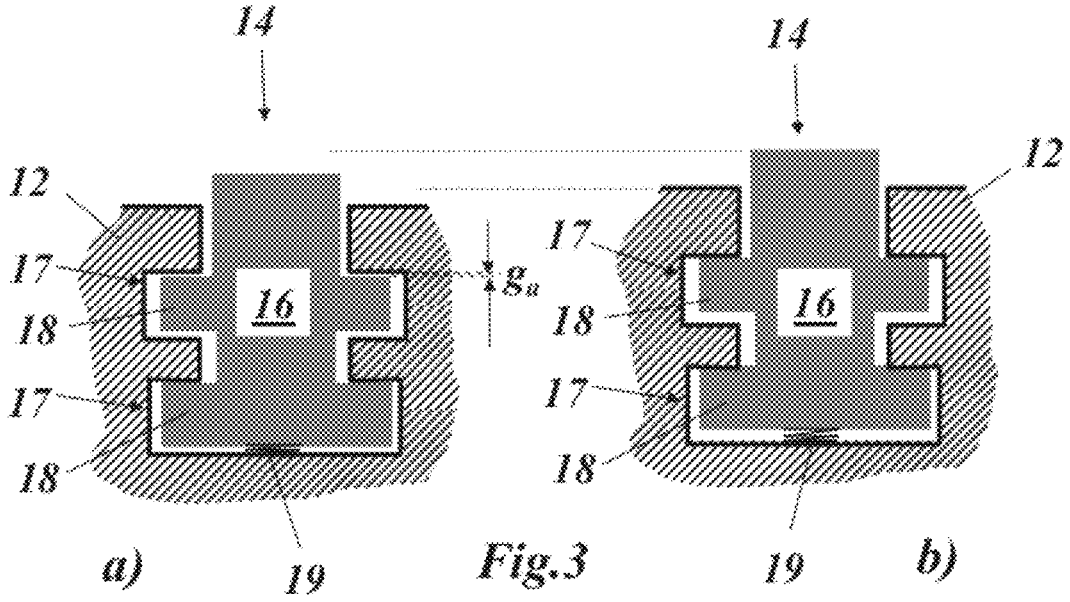
FIG. 3 shows in a greatly simplified sectional view the anchoring of a rotating part (rotor blade) in the rotor in the stationary state (FIG. 3(*a*) and under nominal steady-state operating conditions (FIG. 3(*b*)
Figure 7:
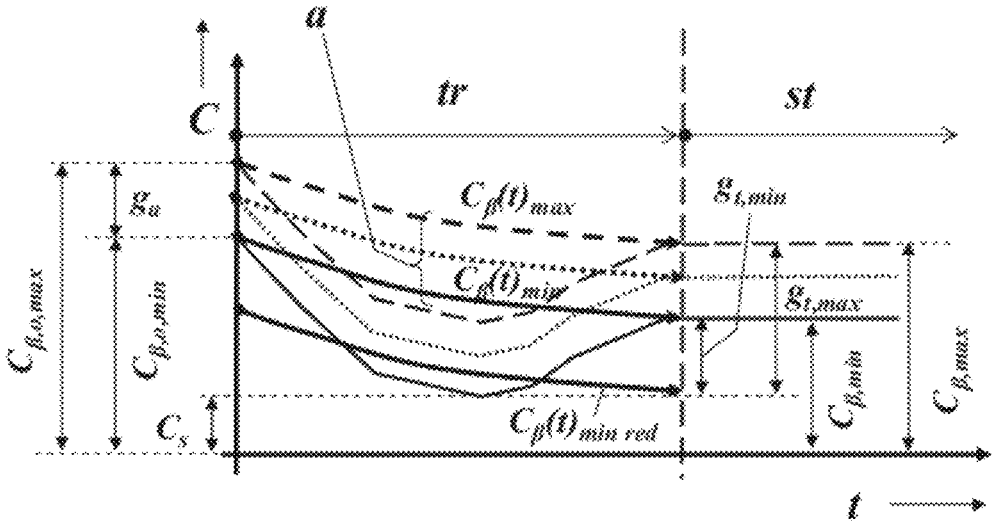
FIG. 7 shows the time dependency of the clearance in a turbomachine having a self-adjusting system according to FIGS. 4 and 6.

FIG. 7 (in comparison to FIG. 2(*a*)) shows the time variation of the clearance at the tip of a rotor blade with built-in self-adjusting device 20 (curves a). The curve $C_\beta(t)_{min\ red}$ demonstrates the possibility which is to reduce the clearance in the cold assembled state and in the hot state by the clearance $g_{t,min}$ being eliminated.

Considering that the same principles can also be applied to the radial movement of the stator heat shield in relation to a rotor blade tip, the designer of the machine has a great deal of freedom in order to set and to control the clearances during transient and steady-state operating conditions.

Considering, furthermore, that the possibility also exists of influencing the cooling air flows and leakage air flows through the rotor and around the rotor parts and stator parts, it is also possible to actively control the behavior of the self-adjusting device 20.

Within the scope of the present disclosure, various shape-memory alloys, bimetals and/or other materials with a comparable behavior have been considered. Their production and their installation into a component have not been discussed in detail since they are known to the person skilled in the art in the field of shape-memory alloys and bimetals. Therefore, a NiTi-based shape-memory alloy, for example, the permissible operating temperature of which reaches up to 200° C. if cooling with secondary air is available in a gas turbine, could be considered in the region of the hot blade root. Ternary high-temperature NiTiX alloys and others, which as the element X contain hafnium Hf, palladium Pd and/or platinum Pt, widen the operating temperature range up to 800° C. and beyond. Naturally, other materials/alloys can also be used within the scope of the invention providing they have the desired and necessary properties.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF DESIGNATIONS

10 Turbomachine
11 Casing
12 Shaft (rotor)
13 Axis
14 Rotor blade
15 Stator blade
16 Root (blade root)
17 Groove
18 Finger
19 Spring element
20 Self-adjusting device
C Clearance
$C_b$ Rotor blade clearance
$C_s$ Safety clearance
$C_v$ Stator blade clearance
$C_{\beta,o,max}$ Maximum clearance (cold)
$C_{\beta,o,min}$ Minimum clearance (cold)
$C_{\beta,max}$ Maximum clearance (hot)
$C_{\beta,min}$ Minimum clearance (hot)
$C_\beta(t)_{min}$ Curve for minimum clearance variation
$C_\beta(t)_{max}$ Curve for maximum clearance variation
$C_\beta(t)_{min\ red}$ Curve for minimum clearance variation with self-adjusting device 20
$g_a$ Tolerance band
$g_t$ Transient gap contribution
$g_{t,max}$ Maximum difference (transient gap contribution)
$g_{t,min}$ Minimum difference (transient gap contribution)
Ω Rotational speed
$\Omega_n$ Rotational speed (nominal)
st Steady-state operating phase
tr Transient operating phase
$T_n$ Hot gas temperature (nominal)
$T_{mn}$ Metal temperature (nominal)
t Time
T Temperature
ϵ Expansion
σ Stress
E Elasticity modulus

The invention claimed is:

1. A turbomachine comprising:

a stationary component;

a rotating component, wherein a clearance is provided to avoid a rubbing contact between the stationary component and the rotating component, the clearance having a first value in a stationary state of the turbomachine and a second value in a steady-state operation of the machine, wherein during a transient operating phase between the stationary state and the steady-state operation, the clearance has a value which traverses a curve having an extreme value on account of a different time variation of a rotational speed and a thermal expansion of different components;

and a compensating device including a non-linear compensation mechanism configured to reduce or compensate the extreme value during the transient operating phase, wherein the compensating device does not have its maximum excursion at the start or end of the transient operating phase but in the transient operating phase itself, where the extreme value of the clearance occurs in the transient operating phase.

2. The turbomachine as recited in claim 1, wherein the compensating device includes a self-adjusting device configured to one of increase and decrease the clearance as a function of an external parameter.

3. The turbomachine as recited in claim 2, wherein the self-adjusting device is configured to change its shape so as to increase or decrease the clearance.

4. The turbomachine as recited in claim 3, wherein the self-adjusting device has a predetermined height, the device being configured to change its height so as to increase or decrease the clearance.

5. The turbomachine as recited in claim 2, the self-adjusting device is configured to increase or decrease the clearance as a function of temperature.

6. The turbomachine as recited in claim 5, wherein the self-adjusting device includes a hysteresis in a temperature behavior of the self-adjusting device.

7. The turbomachine as recited in claim 5, wherein the self-adjusting device includes a bimetal.

8. The turbomachine as recited in claim 5, wherein the self-adjusting device includes a shape-memory alloy.

9. The turbomachine as recited in claim 2, wherein the rotating component includes a rotor blade, the clearance being disposed between a tip of the rotor blade and an oppositely disposed stationary casing.

10. The turbomachine as recited in claim 9, wherein the rotor blade is seated by a blade root in a carrier in a rotor and supported by a supporting device against an aggressive centrifugal force on the rotor, the self-adjusting device being disposed between the supporting device and the rotor.

11. The turbomachine as recited in claim 10, wherein the self-adjusting device is configured to change its height in a radial direction in a temperature-controlled manner between a first and a second value, and wherein a difference between the first and the second value corresponds to the extreme value of the curve.

12. The turbomachine as recited in claim 2, wherein the stationary component includes a stator blade, the clearance being disposed between a tip of the stator blade and an oppositely disposed rotor.

* * * * *